United States Patent [19]

Baldwin et al.

[11] 4,421,486

[45] Dec. 20, 1983

[54] FIELD OF VIEW TEST APPARATUS

[75] Inventors: Dorothy M. Baldwin, Lake Monroe; Frank J. Oharek, Maitland; Archer M. Spooner, Orlando, all of Fla.

[73] Assignee: The United States of America as represented by the Secretary of the Navy, Washington, D.C.

[21] Appl. No.: 362,829

[22] Filed: Mar. 29, 1982

[51] Int. Cl.[3] ..... F41J 9/00

[52] U.S. Cl. ..... 434/44; 352/85; 352/132

[58] Field of Search ..... 434/25, 26, 29, 30, 434/33, 34, 38, 40, 43, 44; 352/85, 132

[56] References Cited

U.S. PATENT DOCUMENTS

| | | | |
|---|---|---|---|
| 3,888,022 | 6/1975 | Pardes et al. | 434/22 |
| 3,998,532 | 12/1976 | Dykes | 434/40 |
| 4,048,653 | 9/1977 | Spooner | 434/43 |
| 4,303,394 | 12/1981 | Berke et al. | 434/40 |
| 4,348,185 | 9/1982 | Breglia et al. | 434/43 |
| 4,348,186 | 9/1982 | Harvey et al. | 434/44 |
| 4,350,489 | 9/1982 | Gdovin | 434/40 |

*Primary Examiner*—Vance Y. Hum
*Assistant Examiner*—Leo P. Picard
*Attorney, Agent, or Firm*—Robert F. Beers; Robert W. Adams; Robert J. Veal

[57] ABSTRACT

A field of view test apparatus utilizes a plurality of interchangeable acrylic masks to vary the resolution characteristics of a projected field of view. An eye or head tracker provides line of sight direction signals to a servo which positions the mask with the optical path of the projection to correlate the area of higher resolution with the direction of the line of sight.

11 Claims, 3 Drawing Figures

FIELD OF VIEW TEST APPARATUS

FIELD OF THE INVENTION

This invention relates to visual projection systems and particularly to visual projection systems for use as training simulators. More particularly, the present invention relates to those visual projection systems which attempt to orient the field of view in relation to the head position or eye position of an observer. In even greater particularity, the present invention may be described as a device for determining field of view parameters for designing visual display apparatus for head and/or eye oriented displays.

BACKGROUND OF THE INVENTION

Present visual simulation technology does not provide for all the necessary variables to simulate the real world completely. Therefore, the actual display obtained must be a trade-off among the various parameters available. In a simulator wherein a wide angle field of view is desirable, or where the image is presented in proper orientation with the viewer's head at all times, such as a head mounted display, an enormous volume of data must be transferred in the image if full detail is given for the entire possible area to be viewed. However, it is not necessary to provide a high detail scene in a non-look direction to obtain realism. System designs therefore should be tailored to match the resolution capabilities of the human eye, thus eliminating unnecessary detail in areas of the display not looked at. The present invention is particularly useful in designing dual channel projection apparatus.

SUMMARY OF THE INVENTION

It appears that realism can be obtained by providing a high resolution area of interest insert within a larger instantaneous field of view to match the resolution capabilities of the human eye. The present invention provides method steps and means for displaying a high resolution image within the lower resolution of the instantaneous field of view area.

The visual acuity of the human eye is one minute of arc in the fovea of the retina. Outside the fovea, the acuity drops rapidly, reaching approximately 1/10 of the foveal acuity at 20° from the fovea.

In order to define the parameters of the acceptable area of interest and instantaneous field of view in a simulator design, the present invention employs a projection system for presenting a wide angle field of view covering a static display. A limbus eye tracker is then used to measure the eye movement of a subject so as to drive one of a plurality of servo driven masks to follow the eye for defining a high resolution area of interest bounded by a lesser resolution instantaneous field of view. A horizontal head tracker can also be used to correlate the head movement.

OBJECTS

It is an object of this invention to provide method steps and means for determining simulator field of view requirements.

It is further object of the present invention to provide variable boundary limits for field of view experimentation.

These and other objects, features and advantages will become apparent to those skilled in the art from reading the accompanying description of a preferred embodiment in conjunction with the appended drawings.

DESCRIPTION OF A PREFERRED EMBODIMENT

The ultimate goal of a visual flight simulation apparatus is to provide a pilot with a displayed scene which is indistinguishable from the real word in terms of pilot performance on the required task. Inasmuch as present visual simulation technology does not provide for all the necessary variables to simulate the real world completely, the actual display obtained must be a trade-off among the available parameters.

Due to the limitations of the human eye in the loop, it is not necessary to provide a high detail scene in a non-look direction. In fact, psycho-physical experiments indicate that realism can be obtained by providing a high resolution area of interest (AOI) within a larger instantaneous field of view (IFOV) to match the resolution capabilities of the human eye.

The visual acuity of the human eye is one minute of arc inside the fovea of the retina, dropping rapidly outside the fovea to 1/10 of foveal acuity at 20° from the fovea. The present invention is intended to assist a systems designer in advantageously using the drop-off in acuity of the human eye in his design criteria by determining preferred parameters for AOI and IFOV for the system being designed.

This is particularly critical in computer image generation (CIG) systems where the volume of data processing and formating would be inordinately high in order to provide a detailed wide angle display. The present invention allows the designer to determine the acceptable AOI requirements for the particular scene content of the display. The detailed display required in the AOI could be provided by a dedicated CIG channel, while the bulk of the display, being less detailed, could be provided by a second CIG channel.

Figure 1:
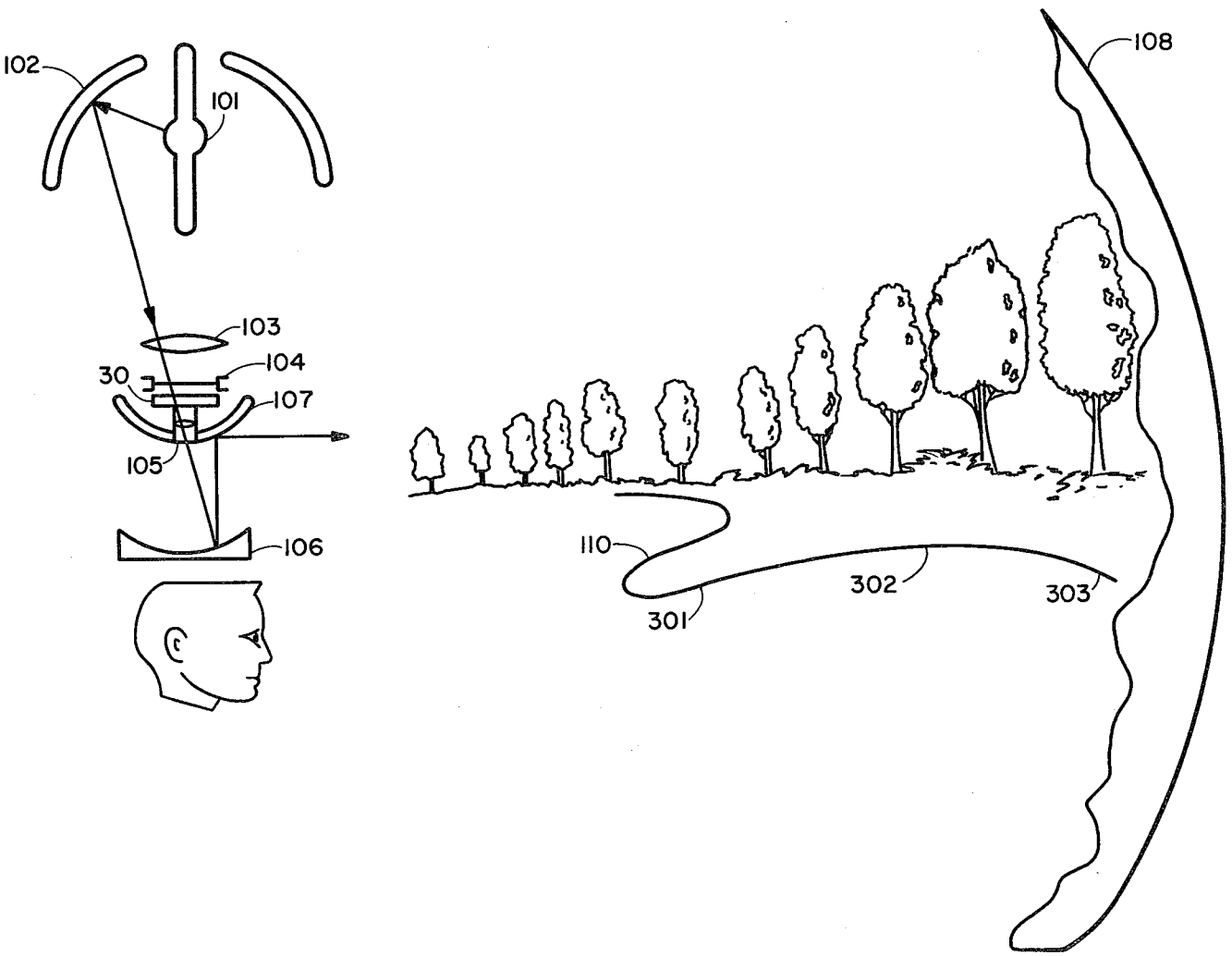
FIG. 1 is a representation of an annular panoramic projection device modified to use the present invention.

The U.S. Navy's Surface Navigation and Orientation Trainer was modified to utilize the teachings of the present invention. FIG. 1 illustrates the Surnot application wherein a projection system 10, such as the Surnot, provides a wide angle, 360° in the Surnot, field of view to a subject 11.

Projection system 10 has been modified by placing a servo-driven variable resolution mask 30 near the image plane of system 10. In the Surnot system, light from a lamp 101 is reflected by a reflector 102 through a condenser set 103, a transparency 104, and a projector lens 105 before reflecting off a concave mirror 106 and a hyperbolic mirror 107 to a screen 108. Mask 30 is placed between transparency 104 and lens 105, thereby superimposing its resolution characteristics on the image from transparency 104. The resultant image 109 then has a resolution profile identified by line 110 in FIG. 1. This corresponds to higher resolution in the AOI 301 and lower resolution in the IFOV 302.

Figure 2:
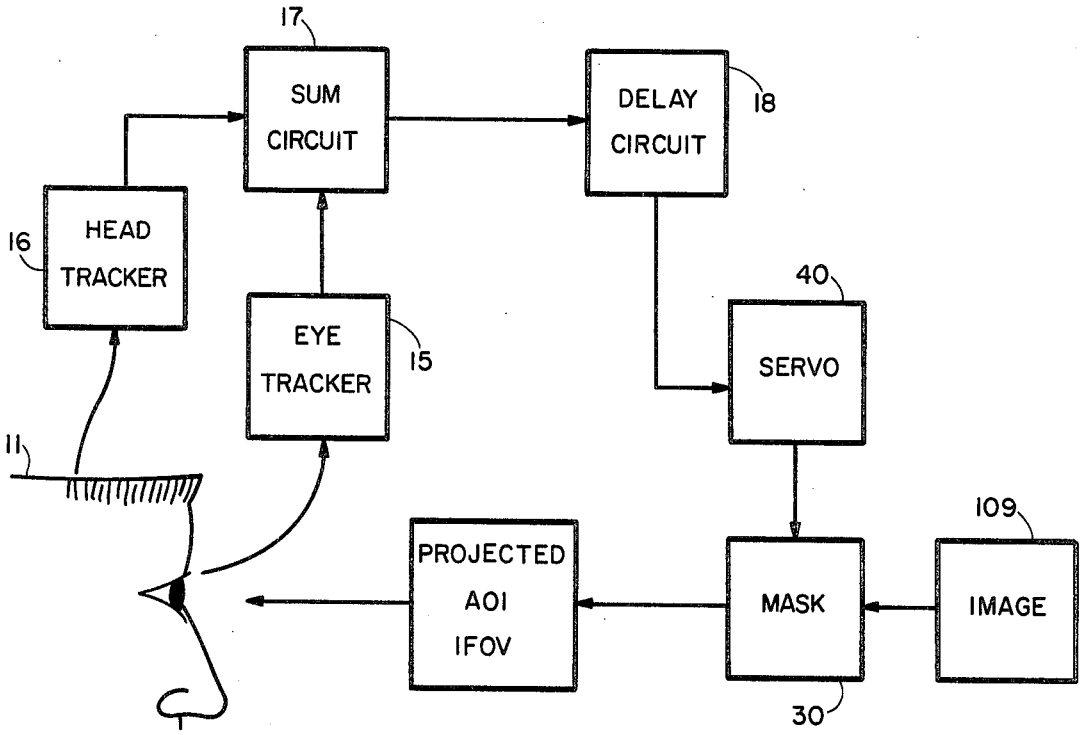
FIG. 2 is a block diagram of the apparatus.

FIG. 2 shows a block diagram of the components of the present invention. AOI 301 and IFOV 302 must of course follow the line of sight of subject 11 to serve any useful purpose. Mask 30 is positioned by a servo 40 which receives input signals from an eye tracker 15 and/or a head tracker 16.

Eye tracker 15 could be any of a number of commercially available eye tracking systems, however in the Surnot system a Bimetrics Model 200 has been found to be suitable. This particular model utilizes a pair of silicon photo transistors operating in conjunction with a gallium arsenide IR source and is calibrated for use with an individual subject 11.

The operating principal of eye tracker 15 depends on detecting the changes in reflected light between the white sclera and the left and right side of the iris. With proper calibration, eye tracker 15 can track ±20° horizontally to an accuracy of $\frac{1}{4}$°.

Head tracker 16 may also be any type sensing device which will provide a signal indicative of position with regard to a given reference. For example, a simple potentiometer can be used to output head position about a vertical axis. Position signals from either head tracker 16 or eye tracker 15 can drive servo 40.

Alternatively, the signal from head tracker 16 and eye tracker 15 are then summed in a sum circuit 17 such that they yield a single value for input to servo 40. The magnitude of this signal determines the displacement of mask 30 to be effected by servo 40.

It should be apparent that a simulator which requires input regarding the head and eye position of subject 11 cannot instantaneously project the correct visual display when head position or eye position changes, without some delay. The amount of acceptable delay is one of the parameters considered in designing a simulator system. Therefore the signal output by sum circuit 17 is routed through a delay circuit 18 which provides a variable delay. In the Surnot application of the invention, the delay could be varied from 17 to 125 milliseconds, thereby providing a range of experimental delays for design tests.

Servo 40 responds to an input of 55 mv/deg and has the following limitations: position error $<2°$; maximum angular velocity $\geqq 6°$ /m sec; dynamic jitter $<5$ percent; throughput delay $\leqq 12$ m sec; and rotation ±90°. Of course, servo 40 was built for use in the Surnot trainer and various different servo parameters can be used depending on the requirements of the trainer under study and the task to be simulated.

The key to the entire system is mask 30. Mask 30 is one of a plurality of acrylic masks, each providing a variation in the resolution profile presented. The masks may be fabricated according to the needs of the particular simulator design under study. For example, a particular simulator system being developed by the Navy used 21 masks to obtain information on optimum AOI and IFOV relationships. The masks had AOI varying from 15° to 110° and IFOV varying from 40° to 180° in a plurality of combinations. The mask may also provide a peripheral screening area 303, preferably in a gray or black color.

Figure 3:
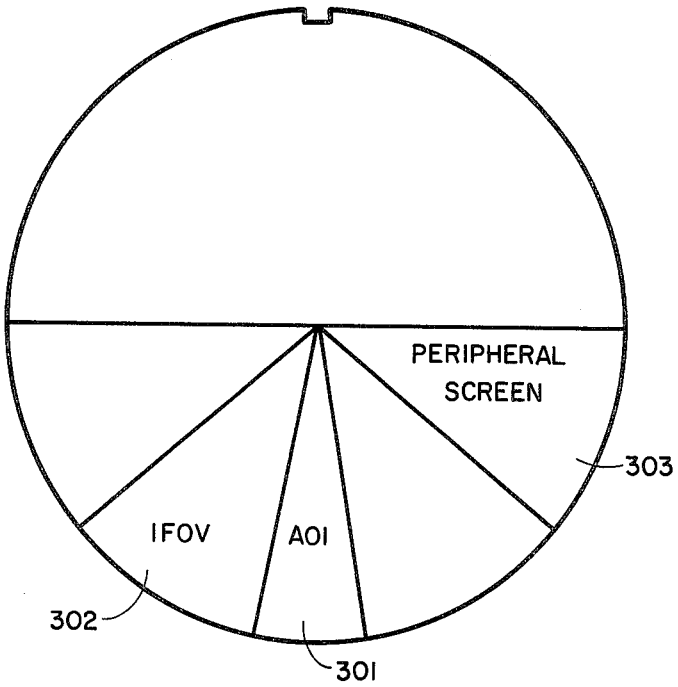
FIG. 3 is a representation of a variable resolution mask for use in the apparatus.

FIG. 3 is a representation of mask 30 wherein AOI 301 is shown bounded by IFOV 302 which is in turn bounded by a peripheral screening area 303.

The embodiment heretofore described is based on the use of a Surnot type projector having an annular projecting lens and a 360° field of view. It should be understood that a variety of projection systems could be used for the purposes of this invention when modified in accordance with the teachings contained herein. Furthermore, although the Surnot system was modified for horizontal tracking only, it should be clear that the present invention can be used with other projection systems for both vertical and horizontal design parameter determinations by providing an additional set of signals to the servo system to correlate to vertical displacement of the high resolution image with the line of sight of observer 11.

In order to utilize the present invention to determine design parameters for a particular visual simulation projection system 10 presents a static or dynamic image 109 on screen 108. The resolution across image 109 is varied by placing one mask 30 in the optical path of projection system 10. A test subject 11 is assigned a task similar to the task required in the desired simulator. Eye tracker 15 or head tracker 16 is attached to subject 11 and servo 40, such that area of intersect 301 is aligned with the line of sight of subject 11. The assigned task is performed and the performance evaluated. Mask 30 is replaced by a second mask 30 having a different resolution pattern and the task is repeated.

The replacement of mask 30 and the performance of the task is iterated until a sufficient base of information has been obtained to match particular resolution requirements with the ability to input data to area of interest 301 and instantaneous field of view 302 for optimum operation of the simulator.

It will be understood that the above description of the present invention is susceptible to various modifications, changes, and adaptations, and the same are intended to be comprehended within the meaning and range of equivalents of the appended claims.

What is claimed is:

1. An apparatus for determining field of view requirements of visual simulator designs comprising:

means for projecting a wide angle visual image such that it may be seen by a test subject, including means for optically varying the resolution of said projected image by an independent masking means to form a high resolution area of interest bounded by an instantaneous field of view having a lesser resolution such that the operational parameters of said area of interest may be determined; means for tracking eye position of said subject while viewing said image, outputting an electrical position indicating signal;

means for varying the position of said area of interest on said projected image in accordance with said position indicating signal; and means for selectively delaying said position indicating signal within a range of delays operably connected between said tracking means and said position varying means such that maximum allowable operational delays may be determined.

2. An apparatus according to claim 1, further comprising:

means for tracking the head position of said test subject, outputting a second electrical position indicating signal; and means for combining said position indicating signal output by said eye tracking means and said second position indicating signal output by said head tracker, outputting a composite position indicating signal.

3. An apparatus according to claim 1 or 2 wherein said eye tracking means is a limbus eye tracker.

4. An apparatus according to claim 2 wherein said position varying means is a servo circuit driven by said combined signal operably connected to said resolution varying means for positioning thereof in accordance with said combined signal.

5. An apparatus according to claim 2 wherein said delaying means is an electrical circuit capable of delaying said combined signal for a selected time interval.

6. An apparatus according to claim 1 wherein said resolution varying means comprises a plurality of interchangeable masks, each mask having a different pattern for said area of interest and said instantaneous field of view, said masks being individually positioned in the optical path of said projecting means so as to superimpose the resolution characteristics of the particular mask on said projected image.

7. An apparatus according to claim 4 wherein said plurality of masks have individual patterns which vary visual parameters including the size of said area of interest, the size of said instantaneous field of view, the resolution drop from said area of interest to said instantaneous field of view, and brightness fall-off between said area of interest and said instantaneous field of view.

8. A method of determining field of view requirements of a visual simulator design comprising the steps of:

projecting a wide angle image on a screen, said projecting step including optically varying the resolution of said image by masking said image to form a pattern having an area of interest of high resolution bounded by an instantaneous field of view of lower resolution;

placing a test subject in a position to view said image;

assigning said subject a visual task related to said simulator design;

correlating the position of said area of interest with the line of sight of said test subject;

evaluating said test subject's performance of said assigned task as a function of the resolution pattern formed;

changing the variation of resolution of said image to form a new pattern;

repeating said task and evaluation;

repeating said pattern changing and task evaluation steps a plurality of times; and selecting the most suitable pattern based on said plurality of evaluations.

9. A method according to claim 8 wherein said resolution varying step comprises placing an acrylic mask having the resolution pattern characteristics in the optical path of said image.

10. A method according to claim 9 wherein said position correlating step comprises:

tracking the eye position of said test subject and obtaining an electrical signal dependent on said eye position;

tracking the head position of said test subject and obtaining an electrical signal dependent on said head position; and electro-mechanically positioning said mask in accordance with said eye and head dependent signals.

11. A method according to claim 9 wherein said variation changing step comprises replacing said acrylic mask with another acrylic mask having a different resolution pattern.

* * * * *